United States Patent [19]

Mudford

[11] Patent Number: 4,938,032

[45] Date of Patent: Jul. 3, 1990

[54] AIR-CONDITIONING SYSTEM

[76] Inventor: Graeme C. Mudford, 9 George St., Ferntree Gully, 3156, Victoria, Australia

[21] Appl. No.: 236,650

[22] PCT Filed: Jul. 14, 1987

[86] PCT No.: PCT/AU87/00216

§ 371 Date: May 16, 1988

§ 102(e) Date: May 16, 1988

[87] PCT Pub. No.: WO88/00676

PCT Pub. Date: Jan. 28, 1988

[30] Foreign Application Priority Data

Jul. 16, 1986 [AU] Australia ..... PH6961

[51] Int. Cl.[5] ..... F25B 13/00

[52] U.S. Cl. ..... 62/160; 62/324.1; 62/238.7

[58] Field of Search ..... 62/160, 324.1, 324.6, 62/324.7, 238.7

[56] References Cited

U.S. PATENT DOCUMENTS

| | | | |
|---|---|---|---|
| 2,098,443 | 11/1937 | Vancott | 62/160 X |
| 2,932,178 | 4/1960 | Armstrong et al. . | |
| 3,188,829 | 6/1965 | Siewert et al. | 62/160 |
| 3,293,874 | 12/1966 | Gerteis . | |
| 3,365,902 | 1/1968 | Nussbaum | 62/160 X |
| 3,460,353 | 8/1969 | Ogata et al. . | |
| 3,779,031 | 12/1973 | Akiyama et al. | 62/160 |
| 4,065,938 | 1/1978 | Jonsson | 62/160 |
| 4,173,865 | 11/1979 | Sawyer | 62/160 X |
| 4,311,020 | 1/1982 | Tobin et al. | 62/160 X |
| 4,482,008 | 11/1984 | Nom | 62/160 X |
| 4,506,521 | 3/1985 | Asano et al. | 62/238.7 |
| 4,516,408 | 5/1985 | Chiba | 62/238.7 |

*Primary Examiner*—Lloyd L. King

*Attorney, Agent, or Firm*—Sughrue, Mion, Zinn, Macpeak & Seas

[57] ABSTRACT

An air-conditioning system which provides a controlled temperature and humidity environment. The system includes two indoor heat exchangers (5,10), one outdoor heat exchanger (2), a four-way valve (8) and a compressor (1). Each heat exchanger (2,5,10) has a respective expansion valve (4A,4C,4B) and electromagnetic shut-off valve (12A,12C,12B) and piping (16,18,20) linking each heat exchanger.

4 Claims, 6 Drawing Sheets

AIR-CONDITIONING SYSTEM

The present invention relates to an airconditioning system and relates particularly, although not exclusively, to an air-conditioning system for providing a controlled temperature and humidity environment for an enclosed space.

The operation concepts of air-conditioning or refrigeration systems are well known. They consist of an evaporator coil, a condensor coil, a thermal-type expansion valve or capillary and a refrigerant compressor. The refrigerant is compressed by the compressor and the high pressure vapour flows to the condensor coil where the heat of compression and latent heat of evaporation are removed from the vapour by means of cooling air blown over the condensor coil. This cooling causes the vapour to condense with the latent heat thus liberated being carried away by the air stream. The resulting high pressure liquid now flows to the expansion valve or capillary where its pressure is reduced and then into the evaporator coil. The liquid in evaporator coil being in the region of reduced pressure boils vigorously, the necessary sensible heat being absorbed from the enclosed space to cool the air. The cycle is then repeated to provide a continuous cooling effect.

To increase the usefulness of such systems a reversing valve (sometimes known as a four-way valve) is inserted in order that the operation of the condensor and evaporator coils may be reversed. In this way in one position the evaporator coil will operate as normal for cooling and in the other position will act as a condensor coil for heating. The disadvantage of such systems is that there is no controlled rate of dehumidification i.e. water vapour removal from the air of the enclosed space. Without such control the temperature of the enclosed space (during cooling) will be progressively lowered in temperature without some form of external heat being applied to the enclosed space.

The insertion of an external heat supply, e.g., electric heating element, after the evaporator coil may overcome this problem. The disadvantages of such a system are firstly, the rate of energy supplied to the external heat supply must be accurately monitored. Secondly, the cost of providing this external heat is relatively expensive when compared with the cost and efficiency of the air-conditioning system. Thirdly, all the external heat energy supplied is not recycled as it is exhausted to the condensor coil. Fourthly, the set up is very complicated from a logistics viewpoint and the control circuitry required to accurately monitor the temperature and humidity is complicated.

To reduce the energy requirements, it has been proposed to insert an additional evaporator coil in parallel with the evaporator coil. An example of this type of air-conditioning system is disclosed in U.S. Pat. No. 3,779,031. This prior art system will only operate as proposed under a limited range of ambient temperatures. During de-humidification the ambient temperature must be higher than the indoor temperature to avoid a lowering of the indoor temperature. A further disadvantage is that in the cooling cycle both indoor coils are in operation. Accordingly a limited range of cooling can only be achieved.

It is an object of the present invention to provide an air-conditioning system which can control temperature and relative humidity without requiring an external heat source.

A further object of the present invention is to provide an air-conditioning system which can control the temperature and relative humidity over a fairly wide range of values.

With these objects in view, the present invention in one aspect provides an air-conditioning system including a compressor, a first heat exchanger (outdoor), a second heat exchanger (indoor), a third heat exchanger (indoor), a four-way valve the inlet of which communicates with said compressor and the three outlets thereof communicating with one end of a respective one of said heat exchangers, each heat exchanger having a respective expansion valve and electromagnetic shut-off valve in line at the other end of the respective heat exchanger, a piping communicating each heat exchanger with the other, and a branch piping communicating said one end of said third heat exchanger to the return of said compressor.

Preferably, a first flow direction valve communicates with the other end of said first heat exchanger in parallel with said first expansion valve and first electromagnetic shut-off valve and communicates with said piping, and a second flow direction valve communicates with the other end of said second heat exchanger in parallel with said second expansion valve and second electromagnetic shut-off valve and communicates with said piping.

In a further aspect of the invention there is provided an air-conditioning system, especially a dehumidification system, including a compressor, a first heat exchanger (indoor), a second heat exchanger (outdoor), a third heat exchanger (indoor), said first and second heat exchangers at one end communicating with said compressor, one end of said third heat exchanger communicating with the return of said compressor, an electromagnetic shut-off valve located between said compressor and said first heat exchanger, piping communicating each heat exchanger with the other and an expansion valve located between the other end of said third heat exchanger and said piping.

In order that the invention may be clearly understood and readily put into practical effect, preferred non-limitative embodiments of an air-conditioning system constructed in accordance with the invention will now be described with reference to the accompanying drawings, in which.

Figure 1:
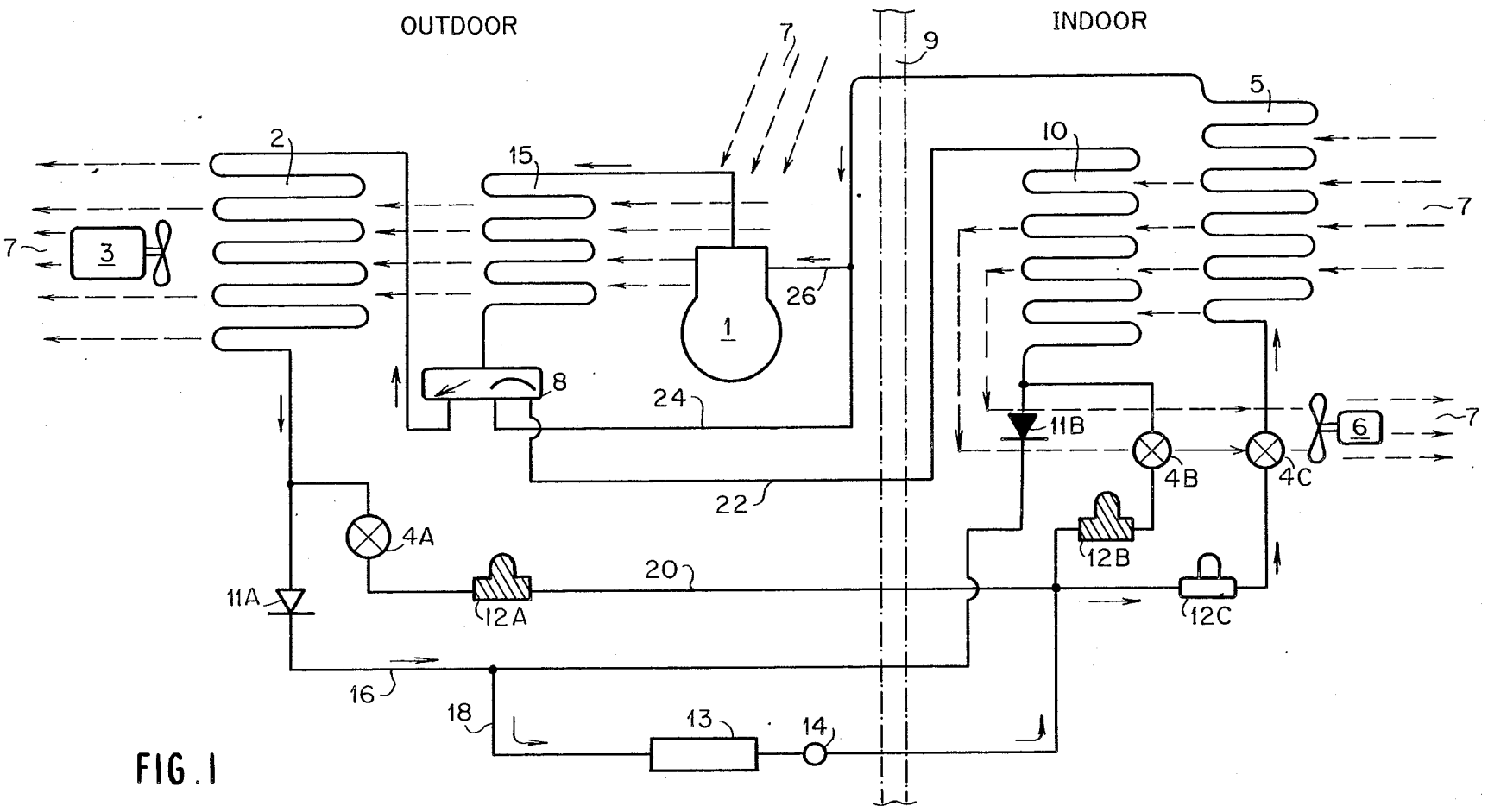
FIG. 1 is a schematic illustration of a first embodiment of an air-conditioning system made in accordance with the invention illustrating a first cooling cycle.

Turning to the FIGS. 1 to 5 there is shown an air-conditioning system for controlling the temperature and relative humidity of an enclosed space, e.g., a room or cabinet. The enclosed space is marked INDOOR and is separated by a wall or insulated bulkhead 9 from the external environment marked OUTDOOR. The system includes a refrigerant compressor 1 which compresses refrigerant in vapour form. Coupled to compressor 1 is an optional, but preferred, refrigerant discharge intercooler (desuperheater) 15 which reduces the "heat of compression". A reversing valve or four-way valve 8 is connected to intercooler 15 to allow the heating/cooling cycle to be reversed. The construction and operation of reversing valves is well established and further explanation thereon is unnecessary. Reversing valve 8 is normally coupled to a first heat exchanger 2. This heat exchanger is cooled by a draught of air from a first fan 3. This cooling causes the vapour to condense (in the cooling mode) whereby the latent heat thus liberated is carried away by the air draught. The refrigerant is now in liquid form under high pressure and is directed through refrigerant flow direction valve 11A, or thermostatic expansion valve 4A located in parallel with valve 11A. The flow path of the refrigerant depends on whether electromagnetic shut-off valve 12A is open or closed.

Line 16 from valve 11A has a side branch 18 which links up with line 20 from electromagnetic shut-off valve 12A through a liquid receiver drier 13 and a liquid line sight glass 14. Line 16 is also directly coupled to line 20.

Reversing valve 8 has a line 22 which is coupled to a second heat exchanger 10. Heat exchanger 10 is similar to first heat exchanger 2 as it also has a second refrigerant flow direction 11B and a second thermostatic expansion valve 4B connected in parallel therewith. Valve 4B is coupled to lines 16 and 20 through a second electromagnetic shut-off valve 12B.

A third heat exchanger 5 is coupled to reversing valve 8 through line 24 to be parallel with heat exchanger 10. Refrigerant compressor 1 has its return 26 coupled to line 24. Heat exchanger 5 does not have a refrigerant flow direction valve but is coupled to lines 18 and 20 via a third thermostatic expansion valve 4C and a third electromagnetic shut-off valve 12C. The INDOOR air is drawn over heat exchangers 5 and 10 by a second fan 6.

For complete climate control fans 3 and 6, electromagnetic shut-off valves 12A, 12B and 12C, reversing valve 8 and refrigerant compressor 1 may be coupled to a switchgear (not shown), preferably microprocessor based, for accurately controlling temperature and relative humidity. By monitoring temperature and relative humidity the switchgear can maintain a desired climate using the invention. The operation of the air-conditioning system will now be described. In the FIGS. 1 to 5 the closed valves are coloured black to assist in tracing refrigerant flow using the flow arrows shown on the Figures.

FIG. 1 shows the air-conditioning system in a first cooling cycle with only valves 4C, 11A and 12C being opened and reversing valve 8 in the first position. In this cycle only heat exchangers 2 (condensor) and 5 (evaporator) are operative. The operation of only one evaporator coil will widen the temperature difference between the INDOOR air and the refrigerant in condensor coil 2 allowing a greater dehumidification during the cooling cycle. The only disadvantage with this cycle is the loss in cooling (sensible) capacity.

Figure 2:
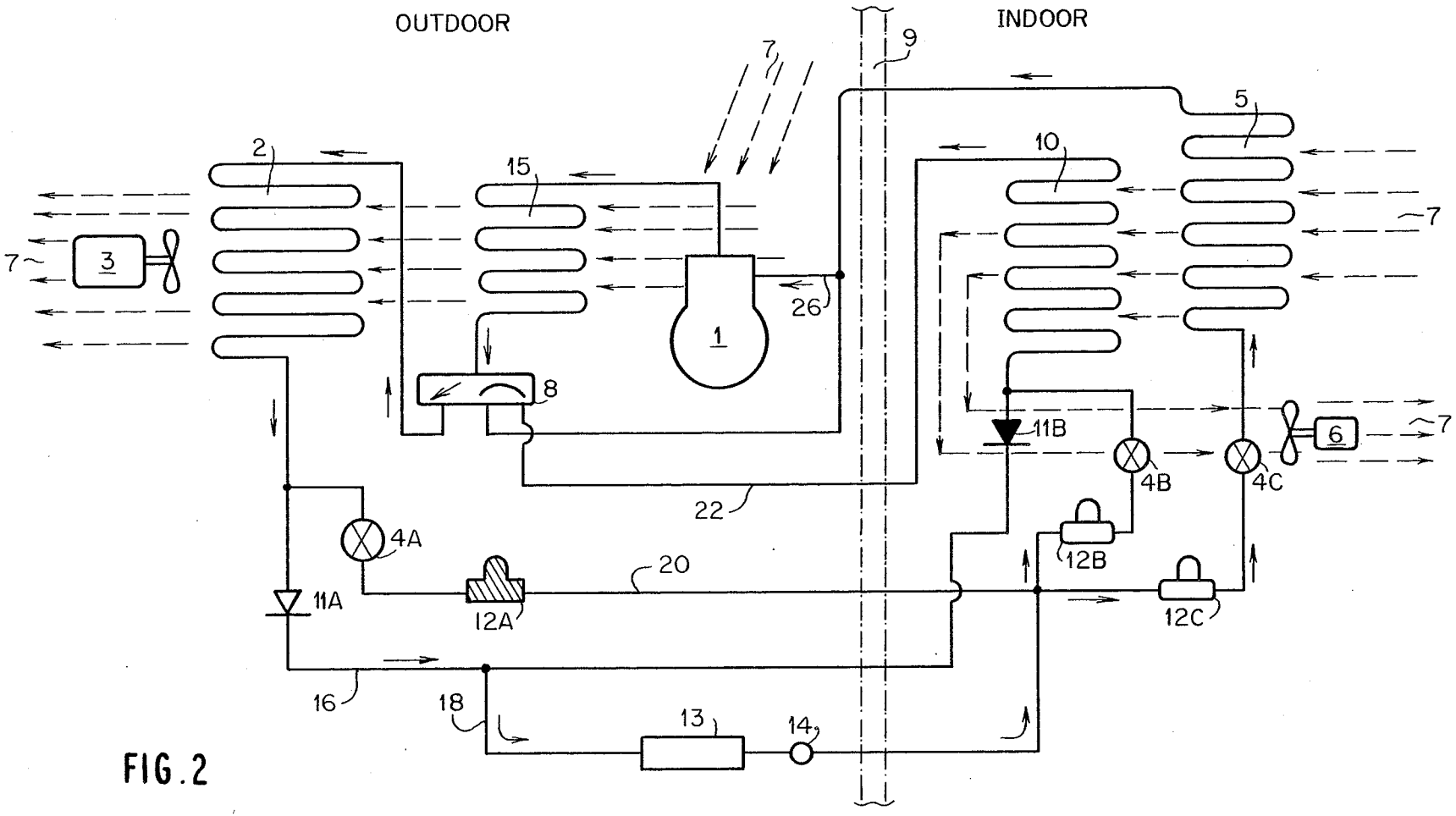
FIG. 2 is the air-conditioning system shown in FIG. 1 illustrating a second cooling cycle.

FIG. 2 shows the air-conditioning system in the conventional cooling cycle with only valves 12A and 11B being closed and reversing valve 8 in the first position. In this cycle all heat exchangers are operative with twin evaporators (5, 10) and a single condensor (2). The temperature difference between the INDOOR air and the refrigerant within exchangers 5, 10 results in a greater cooling (sensible effect with less dehumidification. This cycle has the advantage of a larger cooling capacity and maintenance of a higher indoor relative humidity.

Figure 3:
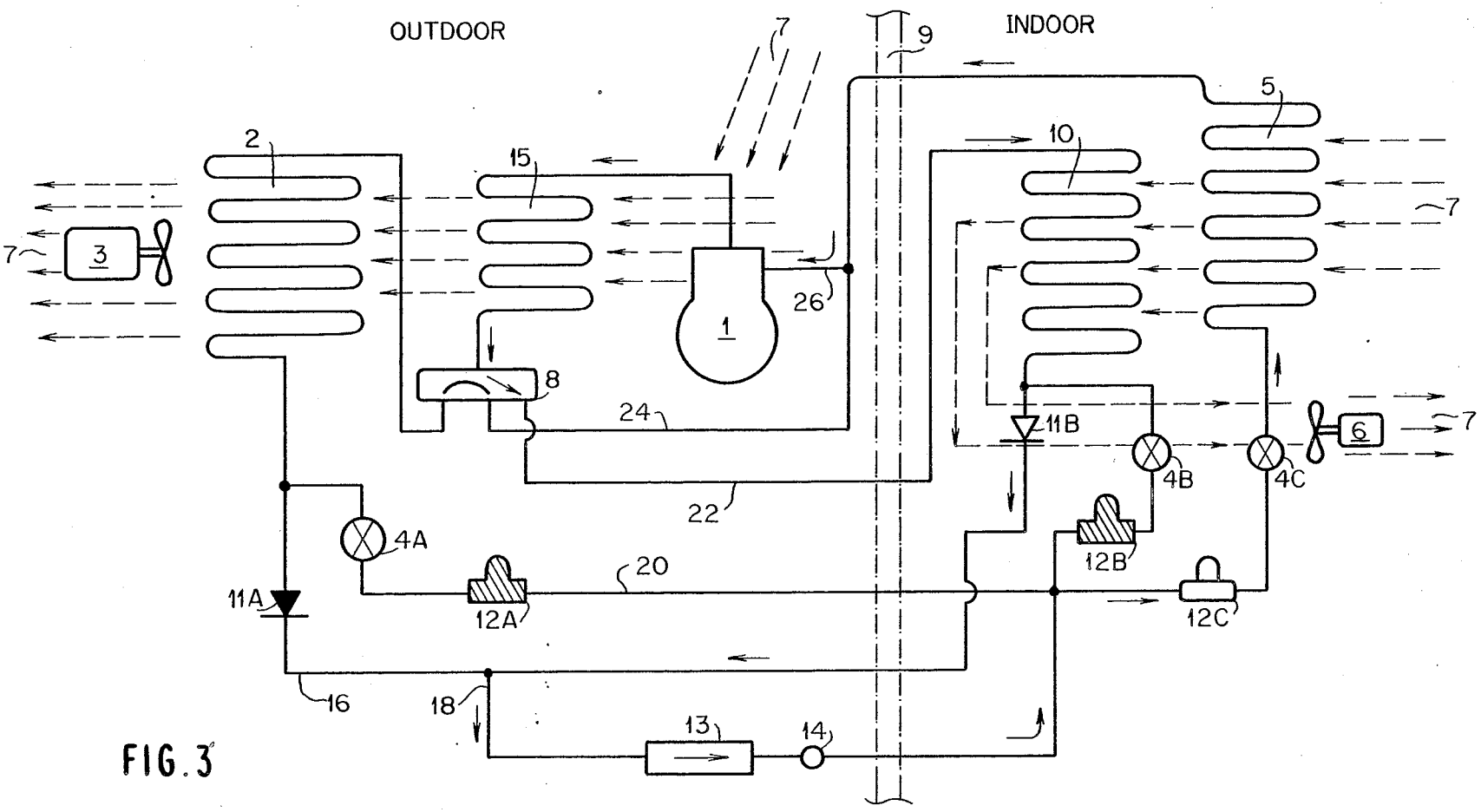
FIG. 3 is the air-conditioning system shown in FIG. 1 illustrating the de-humidification cycle.

FIG. 3 shows the air-conditioning system in the dehumidification cycle with only valves 4C, 11B and 12C being opened and reversing valve 8 in the second position. In this cycle there is one condensor (10) and a single evaporator (5). Accordingly this cycle will provide dehumidification and temperature control. Air is circulated by second fan 6 over third heat exchanger 5 where the air is cooled and water vapour removed from the air because it is lower in temperature than the dew point of the circulating air. After the air has passed over heat exchanger 5 it then passes over the second heat exchanger 10 where it is reheated to a temperature-slightly above the original ambient air temperature. The advantage of this cycle are:

1. The use of a closed refrigeration circuit does not require an external heat supply for dehumidification.
2. The reversing valve allows higher than ambient external temperatures to be maintained in the enclosed space when required.
3. The system is efficient and cost effective because energy is being recirculated. Accordingly no additional heat energy is required to reheat the air, after dehumidification, back to the original INDOOR temperature.
4. A controlled rate of dehumidification is possible.

Figure 4:
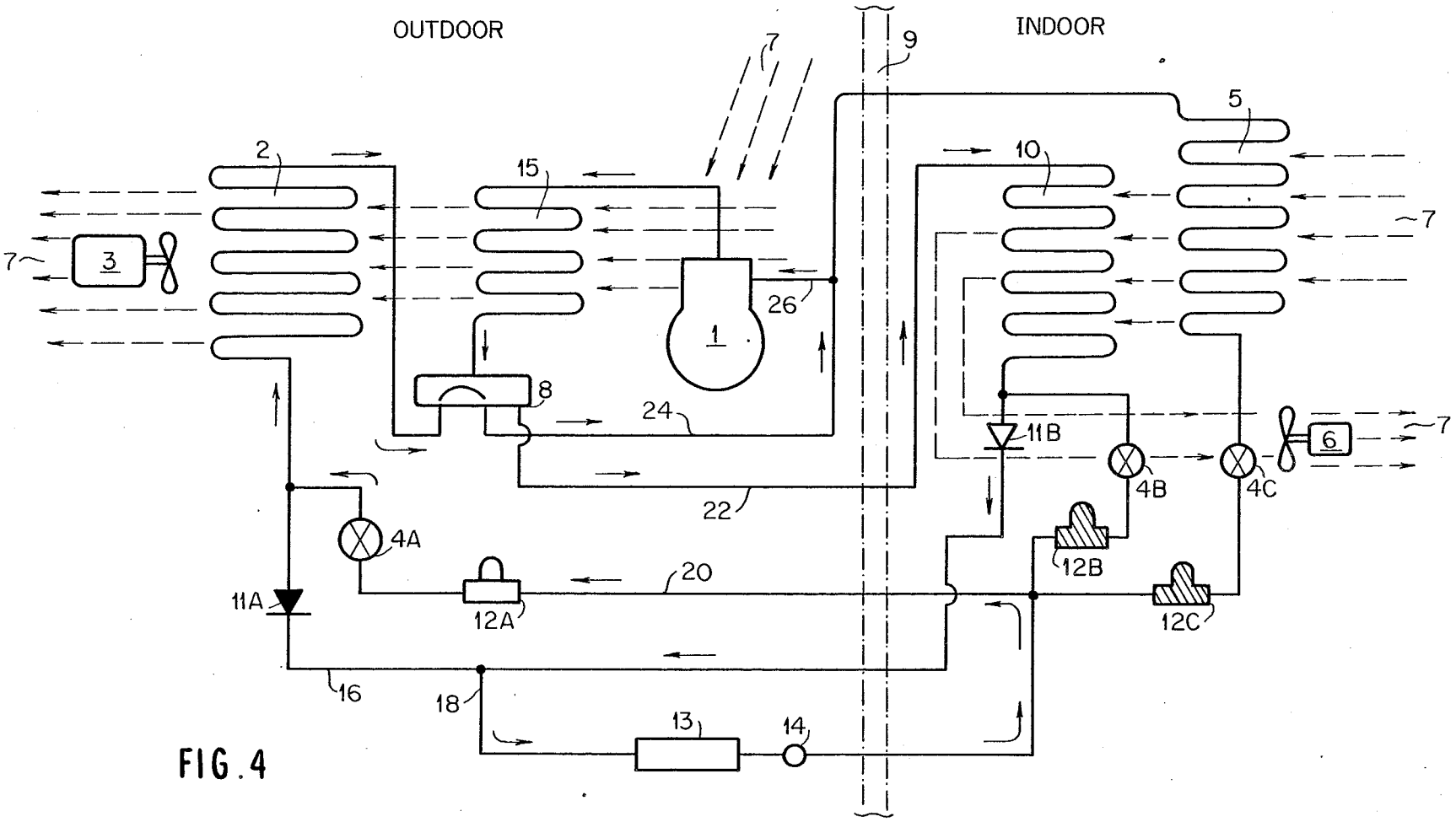
FIG. 4 is the air-conditioning system shown in FIG. 1 illustrating a first heating cycle.

FIG. 4 shows the air-conditioning system in a first heating cycle with only valve 12A being open and reversing valve 8 in the second position. In this cycle there is only one evaporator (2) and one condensor (10) with heat exchanger 5 by-passed. Accordingly the INDOOR air will be heated and so long as the INDOOR air is considered dry air the relative humidity will drop as the sensible temperature rises. In addition, the heat of compression from desuperheater 15 will be drawn across heat exchanger 2 by fan 3 allowing, in low ambient temperatures, less risk of freezing up of heat exchanger 2 and recirculation of the heat of compression into the INDOOR air.

Figure 5:
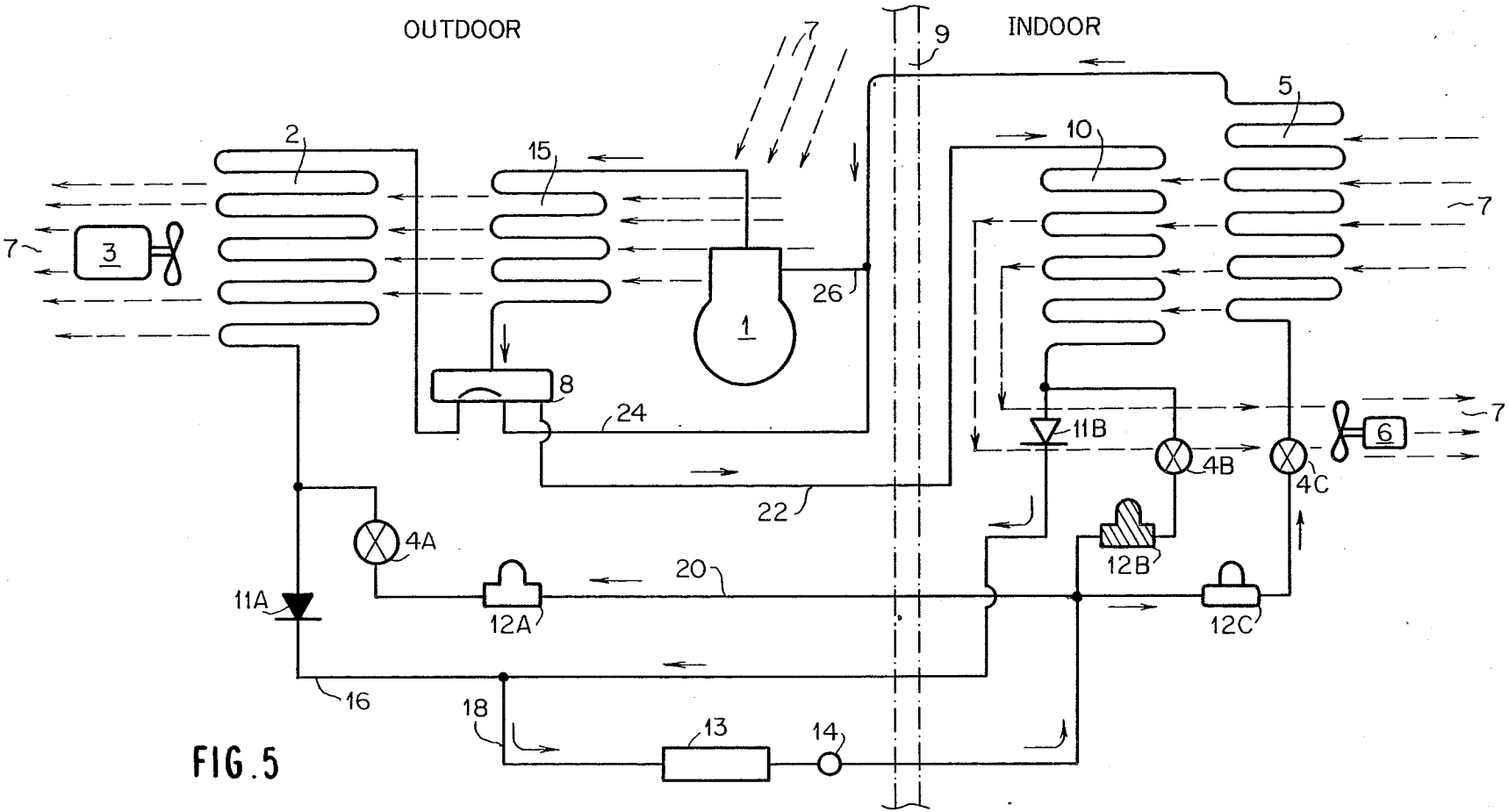
FIG. 5 is the air-conditioning system shown in FIG. 1 illustrating a second heating cycle.

FIG. 5 shows the air-conditioning system in a second heating cycle similar to that of FIG. 4 but with valve 12C also open. In this cycle heat exchanger 5 is not by-passed and will act as an additional evaporator. This arrangement has the advantage that when INDOOR air is heated in the presence of free water vapour, instead of the relative humidity increasing, dehumidification can be controlled. Similarly, this cycle, as with the previous cycle, allows operation at a lower OUTDOOR temperature as desuperheater 15 will prevent heat exchanger 2 from freezing up.

From the above it can be seen that the invention will control the indoor climate over a wide range of outdoor ambient conditions. Such flexibility cannot be obtained from the air-conditioning system shown in U.S. Pat. No. 3,779,031. The invention thus provides:

1. Cooling at low indoor relative humidity.
2. Cooling at high indoor relative humidity.
3. Heating and humidification.
4. Heating and dehumidification.

The control of actuation of the reversing valve 8, electromagnetic shut-off valves 12A, 12B and 12C and fans 3 and 6 by computer means (not shown) will provide very accurate climate control. In practice it has been possible to vary the temperature from 5° to 70° C. with a relative humidity between 10% and 99%. Such flexibility can be used in growth control of plants, e.g.

conditions for growing cacti or alpine plants can be realized. Thus, vastly differing environments can be created. The invention is unlimited in its uses as it can be readily incorporated in air-conditioners for room or office use or for use in environment control chambers.

Figure 6:
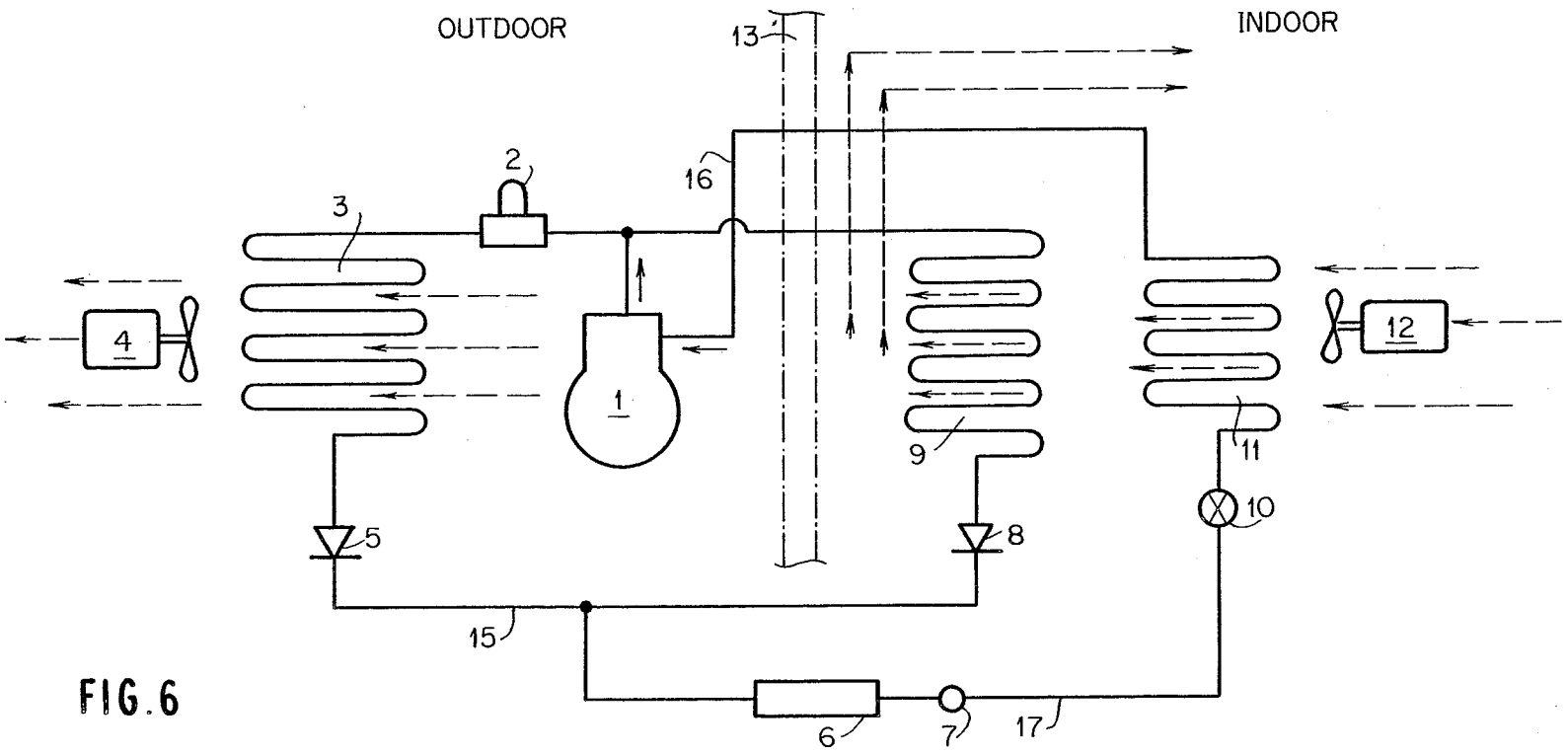
FIG. 6 is a schematic illustration of a second embodiment of an air-conditioning system made in accordance with the invention.

In the second embodiment of the invention shown in FIG. 6 there is shown a dehumidifier system which does not require a reversing valve or the same number of electromagnetic shut-off valves. This system is limited in its capability when compared with the system shown in FIGS. 1 to 5. In the system there is shown a refrigerant compressor 1 serially connected to an electromagnetic shut-off valve 2 a first heat exchanger 3 and a refrigerant flow direction valve 5. A fan 4 is provided to draw air across first exchanger 3. The components so far described are outdoors and separated from the area to be conditioned by insulated bulkhead 13.

The air to be conditioned is on the other side of bulkhead 13. A second heat exchanger 9 is directly coupled to compressor 1 and is linked to line 15 via a second refrigerant flow direction valve 8. A third heat exchanger 11 is coupled to the return line 16 of compressor 1 at one end and is linked to a branch 17 from line 15 at the other end. Branch 17 includes a liquid receiver dryer 6, a liquid line sight glass 7 and a thermostatic expansion valve 10 in its coupling to the third heat exchanger 11. A second fan 12 draws air across heat exchangers 9 and 11 for conditioning the air.

With valve 2 closed heat exchanger 3 will be bypassed and the INDOOR air will be dehumidified in a similar manner to that described with reference to FIG. 3. If valve 2 is opened the dehumidification will not be as great because heat exchanger 3 will operate as a condensor to reduce the heating of the INDOOR air. Accordingly, by simple switching of valve 2 the degree of dehumidification can be controlled.

It is believed that the invention and many of its attendant advantages will be understood from the foregoing description and it will be apparent that various changes may be made in the form, construction and arrangement of the parts and that changes may be made in the form, construction and arrangement of the air-conditioning system described without departing from the spirit and scope of the invention or sacrificing all of its material advantages, the forms hereinbefore described being merely preferred embodiments thereof.

What is claimed:

1. An air-conditioning system including a compressor, an outdoor heat exchanger, a first indoor heat exchanger, a second indoor heat exchanger, a four-way valve having an inlet and three outlets, the inlet of which communicates with said compressor and the three outlets thereof communicating with one end of a respective one of said heat exchangers, each heat exchanger having a respective expansion valve and electromagnetic shut-off valve in line at the other end of the respective heat exchanger, a piping communicating each heat exchanger with the other, and a branch piping communicating said one end of said second indoor heat exchanger to the return of said compressor.

2. An air-conditioning system including a compressor, an outdoor heat exchanger, a first indoor heat exchanger, a second indoor heat exchanger, a four-way valve having an inlet and three outlets, the inlet of which communicates with said compressor with the three outlets thereof communicating with one end of a respective one of said heat exchangers, each heat exchanger having a respective expansion valve and electromagnetic shut-off valve in line at the other end of the respective heat exchanger, a piping communicating each heat exchanger with the other, a first flow direction valve communicating with the other end of said outdoor heat exchanger in parallel with said first expansion valve and first electromagnetic shut-off valve and communicating with said piping, a second flow direction valve communicating with the other end of said first indoor heat exchanger in parallel with said second expansion valve and second electromagnetic shut-off valve and communicating with said piping, and a branch piping communicating said one end of said second indoor heat exchanger to the return of said compressor.

3. The air-conditioning system of claim 1 wherein a refrigerant discharge intercooler is located between said compressor and said inlet of said four-way valve.

4. The air-conditioning system of claim 1, wherein said actuation of said four-way valve and said electromagnetic shut-off valves is computer controlled.

* * * * *